United States Patent [19]

Faubert

[11] 4,346,979

[45] Aug. 31, 1982

[54] PHOTOGRAPHIC DEVELOPING TANK

[75] Inventor: Guy Faubert, Creteil, France

[73] Assignee: Diaralux, Creteil, France

[21] Appl. No.: 237,664

[22] Filed: Feb. 24, 1981

[30] Foreign Application Priority Data

Aug. 18, 1980 [FR] France ..... 80 18060

[51] Int. Cl.[3] ..... G03D 13/04

[52] U.S. Cl. ..... 354/307; 354/329; 354/337

[58] Field of Search ..... 354/312, 313, 329, 330, 354/331, 307, 337

[56] References Cited

U.S. PATENT DOCUMENTS 3,977,876 8/1976 Ratowsky ..... 354/329
4,219,269 8/1980 Bernhardt ..... 354/329
4,277,159 7/1981 Descotes ..... 354/330

FOREIGN PATENT DOCUMENTS 287685 8/1966 Canada ..... 354/329

*Primary Examiner*—Richard A. Wintercorn
*Assistant Examiner*—Alan Mathews
*Attorney, Agent, or Firm*—Wolf, Greenfield & Sacks

[57] ABSTRACT

This invention concerns a light-tight photographic developing tank in which the end orifice opening onto the exterior of the body is orientated laterally to the axis of the tank and in which the orifice opening into the interior of the body is raised up above the lower generatrix of the cup disposed according to the axial plane of the cup which is perpendicular to the plane of the filling orifice opening onto the exterior of the cup.

9 Claims, 6 Drawing Figures

PHOTOGRAPHIC DEVELOPING TANK

The invention concerns photographic developing tanks.

Photographic developing tanks consist of a cylinder including internally a cup into the interior of which is poured the active product before acting on the exposed sensitive paper which is placed against the internal wall of the tank.

When the cup is being filled with the product, the tank is in a vertical position, then when the tank is arranged horizontally, the product in the cup runs out into the tank through orifices provided for this purpose and comes into contact with the sensitive paper.

The tank is then set in rotation about its axis so that the product acts uniformly on the whole surface of the sensitive paper disposed along the internal wall of the tank.

However, this known apparatus has a disadvantage resulting from the fact that while the tank is being swung from its vertical position to its horizontal position, the product comes into contact with that part of the sensitive paper situated at the level of the lower generatrix of the tank and begins to produce its chemical action on this part of the paper to such an extent that, after the tank has been set in rotation to produce the development on the whole surface of the paper, it is observed that the development is more pronounced at the level of the zone of the paper which has been initially put into contact with the product.

These development defects also result from the fact that, during the manipulations of the tank during its passage from the vertical position to the horizontal position, the active liquid is agitated and produces splashes which result in stains on the developed paper.

The particular object of the present invention is to remedy these defects and concerns for this purpose a photographic developing tank comprising a cylindrical body including internally a cup to receive the product before acting on the exposed sensitive paper disposed within the body, the cup having an end orifice opening to the outside of the body for the filling, during a first phase, of the cup with the product, as well as at least one orifice opening into the interior of the body for the discharge, in a second phase, of the product from the cup into the body, the tank being characterised in that the end orifice opening onto the exterior of the body is laterally oriented to the axis of the tank and in that the orifice opening into the interior of the body is brought forward of the lower generatrix of the cup disposed following the axial plane of the tank which is perpendicular to the plane of the filling orifice opening to the exterior of the tank.

According to another characteristic of the invention, the orifice of the cup opening into the interior of the body is constituted by a longitudinal slot.

According to another characteristic of the invention, the cup has an internal partition opposite the orifice opening into the interior of the body.

According to another characteristic of the invention, the cup includes a cup cover, this cover having on one of its faces an elongation forming the orifice of the cup opening onto the exterior of the body and on its other face an elongation forming the internal partition.

The invention is shown, by way of non-limiting example, in the attached drawings, in which.

Figure 1:
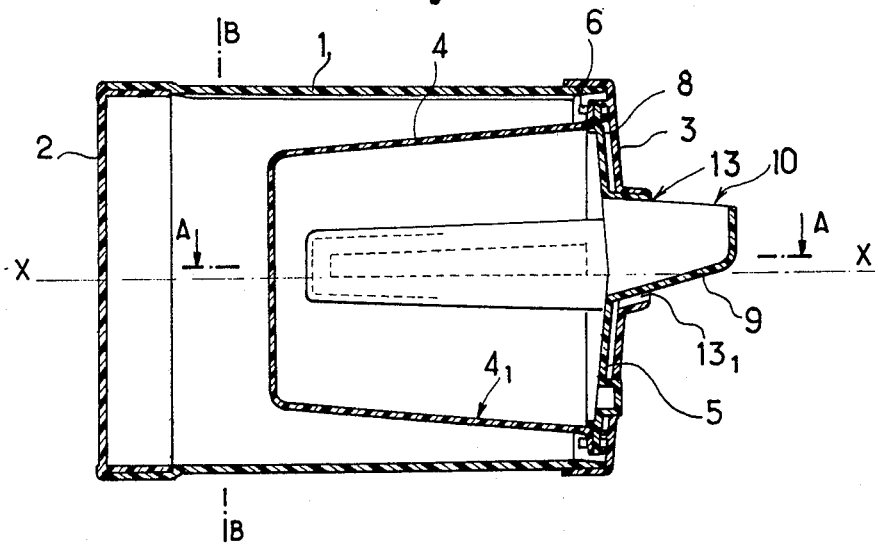
FIG. 1 is a cross-sectional view of the tank.
Figure 2:
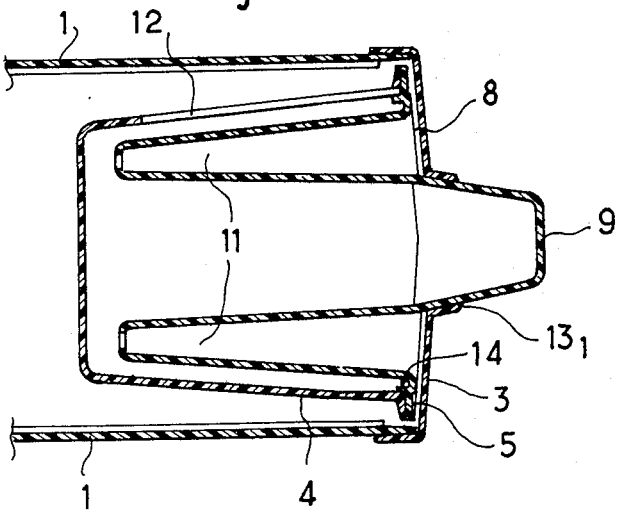
FIG. 2 is a partial section along A—A of FIG. 1.
Figure 3:
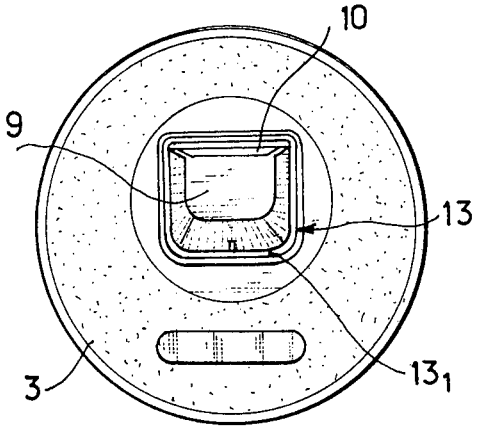
FIG. 3 is a view to the right of FIG. 1.
Figure 4:
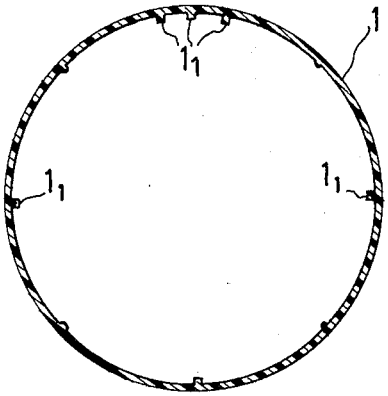
FIG. 4 is a sectional view along B—B of FIG. 1.
Figure 5:
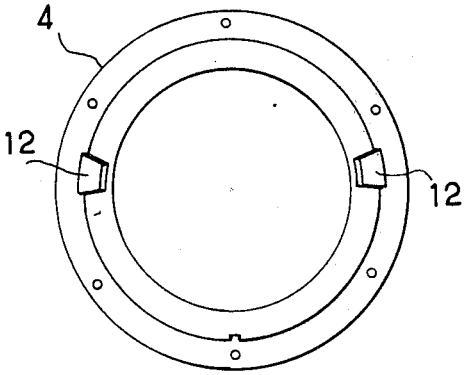
FIG. 5 is a view from the right of the cup of FIG. 1.
Figure 6:
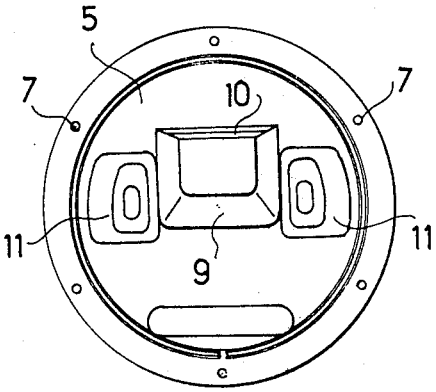
FIG. 6 is a view from the right of the cup cover of FIG. 1.

In consequence, the object of the present invention is to provide a light-tight photographic developing tank which permits there to be obtained a uniform development of exposed sensitive paper by ensuring that the active liquid product is disposed regularly over the whole of the depth of the tank only when this is set in rotation about its axis.

This tank comprises a cylindrical body 1 closed at one of its ends by a base 2 and at its other end by a cover 3.

In the interior of the tank is disposed a cup 4, for example in the form of a truncated cone, which is closed by a cover 5.

The cover 3 of the body has, on its internal surface, studs 6 which are passed through the corresponding orifices formed in the cup 4 and in the cover 5 in order to assemble simultaneously the cup on its cover and the assembly on the cover 3.

These studs 6 ensure the fixing of the cup and its cover in such a manner that the cover 5 defines with the internal surface of the cover 3 a lamellar space 8 which opens onto the periphery of the body 1.

The cover 5 has, on its external face, a hollow elongation 9 which is terminated in an orifice 10 orientated laterally to the X—X axis of the tank.

Furthermore, on its internal surface, this cover 5 has two tips determining extensions 11 which are disposed laterally of the extension 9 and with regard to two substantially opposite longitudinal slots 12, provided on the cup 4.

The extension 9 of the cover 5 of the cup passes through an orifice 13 in the cover 3 so that the orifice 10 is situated on the exterior of the tank.

Further, this orifice 13 is larger than the extension 9 which receives it and form between them a passage $\mathbf{13}_1$ which is situated opposite the extension 9 on the opposite side of the orifice 10.

The zone of assembly of the cup 4 and its cover 5 has ribs and complementary grooves 14 in order to form an obstruction to prevent their assembly except in a predetermined angular position for which the extensions 11 form partitions situated opposite the slots 12.

The internal wall of the body 1 includes ribs $\mathbf{1}_1$ which are positioned in such a way as to constitute positioning stops for photographic developing papers of standard dimensions.

The operation of the tank is as follows:

Given that the orifice 10 is positioned laterally on the exterior of the tank to enable the active product to be poured into the cup, it is recommended to place the tank horizontally, the orifice 10 being directed upwards.

During the charging of the product through the orifice 10, the former accumulates in the lower part of the cup 4 occupied by the generatrix $\mathbf{4}_1$ disposed in the axial phase (the plane of FIG. 1) which is perpendicular to the orifice 10.

In this position, there is no risk for a single moment of the liquid poured in being projected into the interior of the body 1, given that the longitudinal slots 12 are situated at an intermediate height and are protected by the partitions 11.

When the tank is set in rotation about its X—X axis, the liquid contained in the cup flows rapidly through one of the orifices 12 and accumulates in the base part of the body 1 such that the rotation of the tank causes successive immersion of the whole of the sensitive paper in the liquid.

It will consequently be noted that the sensitive paper only comes into contact with the liquid after the rotation of the tank has commenced, which guarantees a photographic development free from stains and irregularities.

I claim:

1. A light-tight photographic developing tank comprising a cylindrical body (1) containing a cup (4) to receive a product before said product acts on an exposed sensitive paper disposed within the body, the cup having a filling orifice (10) on an extremity opening to the exterior of the body for filling the cup with the product when the tank is in a first position wherein said filling orifice (10) is substantially horizontal, said cup (4) further comprising at least one discharge orifice (12) opening into the interior of the body (4) to discharge the product in the cup into the body when the tank is rotated around the axis of the cylindrical body away from said first position, said filling orifice (10) being oriented laterally to the axis of the body of the tank (1), and, when the tank is in said first position, the discharge orifice (12) being disposed above the lower generatrix of the cup disposed in the axial plane of the cup which is perpendicular to the plane of the filling orifice (10).

2. The photographic developing tank of claim 1, wherein the discharge orifice (12) comprises a longitudinal slot.

3. The photographic developing tank of claim 1, wherein the cup has an internal partition (11) substantially opposite the discharge orifice (12).

4. The photographic developing tank of claim 3, wherein the cup (4) includes a cup cover (5) having interior and exterior faces, said filling orifice (10) being formed as an elongation on the exterior face of said cup cover, and said internal partition (11) being formed as an elongation on the interior face.

5. The photographic developing tank of claim 4, wherein the cup includes two longitudinal discharge orifices (12), said orifices being disposed substantially opposite said partitions (11) and being disposed substantially laterally of the elongation forming the filling orifice (10).

6. The photographic developing tank of claim 5, wherein the body (1) includes an end cover (3), said cover being provided with an orifice (13) through which said elongation of the cup cover extends to the exterior of the body.

7. The photographic developing tank of claim 6, wherein orifice (13) of the end cover (3) cooperates with elongation (9) of the cup cover (5) to define an emptying passage ($13_1$) for emptying to product from the body.

8. The photographic developing tank of claim 7, wherein the emptying passage ($13_1$) is located on the side of elongation (9) which is opposite to filling orifice (10).

9. The photographic developing tank of claim 8, wherein end cover (3) and cup cover (5) cooperate to define a lamellar space (8) opening into the periphery of the body (1).

* * * * *